US006056519A

United States Patent [19]

Morita et al.

[11] Patent Number: 6,056,519

[45] Date of Patent: May 2, 2000

[54] STRUCTURE OF VIBRATING COMPRESSOR

[75] Inventors: Ichiro Morita; Masanori Kobayashi; Koh Inagaki, all of Fujisawa; Makoto Katayama, Zushi, all of Japan

[73] Assignee: Matsushita Refrigeration Company, Osaka, Japan

[21] Appl. No.: 09/170,044

[22] Filed: Oct. 13, 1998

[30] Foreign Application Priority Data

Oct. 15, 1997 [JP] Japan ..... 9-281732
Apr. 28, 1998 [JP] Japan ..... 10-118364

[51] Int. Cl.[7] ..... F04B 35/04

[52] U.S. Cl. ..... 417/415; 417/417; 267/161

[58] Field of Search ..... 417/415, 363, 417/416, 417, 437; 267/160, 161, 162; 60/520

[56] References Cited

U.S. PATENT DOCUMENTS 5,255,521 10/1993 Watanabe .
5,351,490 10/1994 Ohishi et al. ..... 62/6
5,469,291 11/1995 Plesko ..... 359/224
5,525,845 6/1996 Van Der Walt Nichoras .
5,920,133 7/1999 Penswick et al. ..... 310/17

FOREIGN PATENT DOCUMENTS 0 028 144 5/1981 European Pat. Off. .
0 553 818 8/1993 European Pat. Off. .
4-347460 12/1992 Japan .
5-288419 11/1993 Japan .

*Primary Examiner*—Teresa Walberg
*Assistant Examiner*—Thor Campbell
*Attorney, Agent, or Firm*—Louis Woo

[57] ABSTRACT

A vibrating compressor which may be employed in refrigerators is provided which includes an elastic mechanism designed to produce reaction against movement of a piston through a moving mechanism such as an electric motor to oscillate the piston to change the volume of a compression chamber. The elastic mechanism consists of a plurality of discs connecting at the center with the piston. Each of the discs has slits curved in a scroll fashion to form spring arms. The discs are laid to overlap each other and shifted in angular position from each other so that the arms of one of the discs coincide with the slits of adjacent one of the discs, thereby avoiding direct contact of the arms of adjacent two of the discs.

9 Claims, 11 Drawing Sheets

STRUCTURE OF VIBRATING COMPRESSOR

BACKGROUND OF THE INVENTION

1. Technical Field of the Invention

The present invention relates generally to a vibrating, compressor which may be used in refrigerators, and more particularly to an improved structure of an elastic mechanism of a vibrating compressor which induces oscillation of a piston of the compressor.

2. Background of Related Art

Japanese Patent First Publication Nos. 4-347460 and 5-288419 disclose vibrating compressors designed to oscillate a piston to change the volume of a compression chamber on intake and compression through an elastic mechanism. The elastic mechanism consists of a plurality of discs. Each disc has spiral slits to form spring arms which produce the reaction force against the movement of the piston in one direction to reciprocate the piston within a cylinder. The discs are laid to overlap each other. Spacers are interposed between adjacent two of the discs to avoid direct contact thereof which will lead to wear or breakage of the spring arms. The use of the spacers, however, increases the size of weight of the elastic mechanism and decreases the resonance frequency of a moving member including the piston, thus resulting in a decrease in capacity of the compressor. Additionally, the oscillation of the discs causes the stress to concentrate on both ends of each spring arm, which will lead to a fatigue failure of the spring arms.

SUMMARY OF THE INVENTION

It is therefore a principal object of the present invention to avoid the disadvantages of the prior art.

It is another object of the present invention to provide a compact and light weight structure of an elastic mechanism of a vibrating compressor having an increased fatigue life.

According to one aspect of the present invention, there is provided a vibrating compressor which comprises: (a) an enclosed casing; (b) a block having formed therein a cylinder within which a piston reciprocates to change a volume of a compression chamber; (c) a moving mechanism moving the piston within the cylinder in a first direction; and (d) an elastic unit including a plurality of plates each of which is connected at a first portion to said block and at a second portion to the piston and each of which has formed therein at least one slit curved to define an arm which is elastically flexed to urge the piston in a second direction opposite the first direction in response to the movement of the piston through said moving mechanism, the slit of each of the plates being greater in width than the arm, the plates being disposed adjacent to each other so that the arm of each of the plates overlaps with the slit of adjacent one of the plates.

In the preferred mode of the invention, the slit of each of the plates has an end oriented geometrically so as to coincide with a portion of a normal to a longitudinal center line of the slit.

A second curved slit is further provided which extends from the end of the slit and which has a width smaller than that of the slit.

Each of the plates has formed therein recesses adjacent the ends of the slit. The plates coincide in center with each other and are shifted in angular position from each other so that portions of each of the plates neighboring the recesses thereof engage the recesses of adjacent one of the plates.

The arm of one of the plates is different in dimension from that of another of the plates.

The outer end of the slit of each of the plates is oriented outward at a given angle away from a normal to a longitudinal center line of the slit. The given angle ranges from −10° to 60°, preferably from 10° to 50°.

The inner end of the slit of each of the plates is oriented inward at a given angle away from a normal to a longitudinal center line of the slit. The given angle ranges from −30° to 30°.

The ends of the slit of each of the plates engage and hold outer and inner end portions of the arm of adjacent one of the plates during flexing of the arms accompanied by movement of the piston. The ends of the slit of each of the plates have tapered surfaces facing a bottom dead center of the piston.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
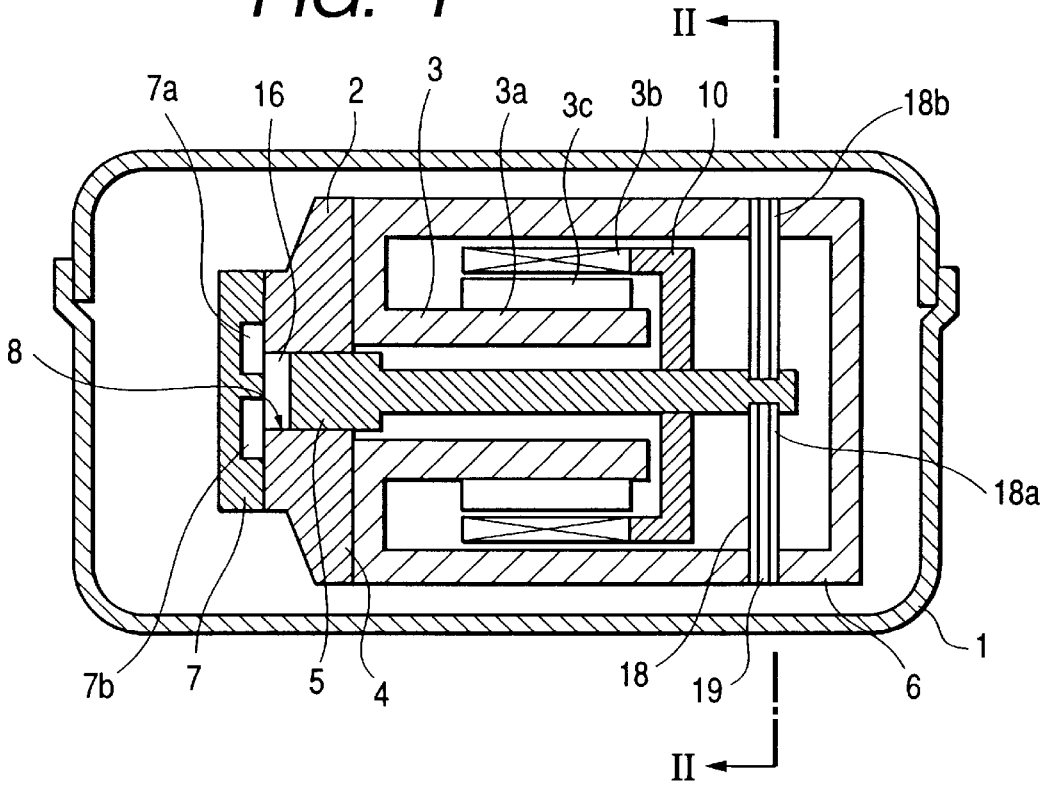
FIG. 1 is a vertical sectional view which shows a vibrating compressor according to the invention.

Referring now to the drawings, particularly to FIG. 1, there is shown a vibrating compressor according to the invention which may be employed in refrigerators.

The vibrating compressor includes generally the enclosed casing 1 and the compressor mechanism 2. The compressor mechanism 2 consists of the electric motor 3, the cylinder block 4, the piston 5, the hollow block 6, the cylinder head 7, and the elastic unit 8 and is supported within the casing through suspension springs (not shown).

The cylinder block 4 has formed therein the cylinder 8 within which the piston 5 reciprocates to suck, for example, a refrigerant from the inlet 7*a* into the compression chamber 16 and to discharge it from the outlet 7*b* to a refrigerating system.

The motor 3 consists of the stator 3*a* made from pure iron and the rotor 3*b* made of a coil. The stator 3*a* has disposed thereon the permanent magnet 3*c*. The rotor 3*b* is connected to the piston 5 through the joint 10.

The elastic unit 18 consists of a plurality of discs 19 (three in this embodiment) laid to overlap each other. The discs 19 are connected at the central portions 18*a* to an end of the piston 5 and at the peripheral portions 18*b* to the block 6. Each of the discs 19, as clearly shown in FIGS. 2 and 3, has formed therein the arc-shaped slits 20*a*, 20*b*, 20*c* and 20*d*, to define the arms 21*a*, 21*b*, 21*c*, and 21*d* which extend in a scroll fashion so that the disc 19 can be flexed in a direction perpendicular to the faces thereof.

The slits 20*a* to 20*d* are defined in width by the inner side edges 22*a*, 22*b*, 22*c*, and 22*d* and the outer side edges 23*a*, 23*b*, 23*c*, and 23*d* of the arms 21*a* to 21*d* and in length by the inner ends 24*a*, 24*b*, 24*c*, and 24*d* and the outer ends 25*a*, 25*b*, 25*c*, and 25*d*, respectively. The slits 20*a* to 20*d* have the width greater than that of the arms 21*a* to 21*d*.

The discs 19 are shifted from each other in the circumferential direction thereof by 45° so that both ends of the arms 21*a* to 21*d* of each of the discs 19 may coincide with the inner ends 24*a* to 24*d* and the outer ends 25*a* to 25*d* of the slits 24*a* to 24*d* of adjacent one of the discs 19. In other words, the arms 21*a* to 21*d* of each of the discs 19 overlap with the slits 24*a* to 24*d* of adjacent one of the discs 19.

In operation, when the current is provided from an ac power supply to the rotor 3*b* of the motor 3, the rotor 3*b* is excited and moved along with the piston 5 in a longitudinal direction thereof within the electric field produced by the magnet 3*c*, pressing the elastic unit 18. The elastic unit 18 produces a reaction force to move the piston 5 in the opposite direction, thereby causing the piston to oscillate to increase and decrease the volume of the compression chamber 16 alternately.

When the elastic unit 18 is pressed by the piston 5, the arms 21*a* to 21*d* of the discs 19 are flexed or moved in a direction perpendicular to the faces of the discs 19. The arms 21*a* to 21*d* of each of the discs 19, as described above, overlap with the slits 24*a* to 24*d* of adjacent one of the discs 19. The arms 21*a* to 21*d* of outer two of the discs 19 are, thus, always spaced from each other at a constant interval corresponding to the thickness of the disc 19. Specifically, the arms 21*a* to 21*d* of all the discs 19 are moved in the longitudinal direction of the piston 5 with constant clearances therebetween regardless of the amount of movement of the piston 5. This avoids the wear or breakage of the arms 21*a* to 21*d* which would be caused by rubbing of the arms 21*a* to 21*d* of any adjacent two of the discs 19 during the oscillation of the piston 5.

Each of the discs 19 may alternatively have formed therein a single slit extending in a scroll fashion to form a single arm. It is advisable that the slit, like the above embodiment, be greater in width than the arm and that the arm of each of the discs 19 overlap the slit of adjacent one of the discs 19 for avoiding the rubbing of the arms of any adjacent two of the discs 19.

Instead of the motor 3 consisting of the rotor 3*b* and the permanent magnet 3*c*, any other known moving mechanisms may be used which are capable of reciprocating the piston 5.

Figure 4:
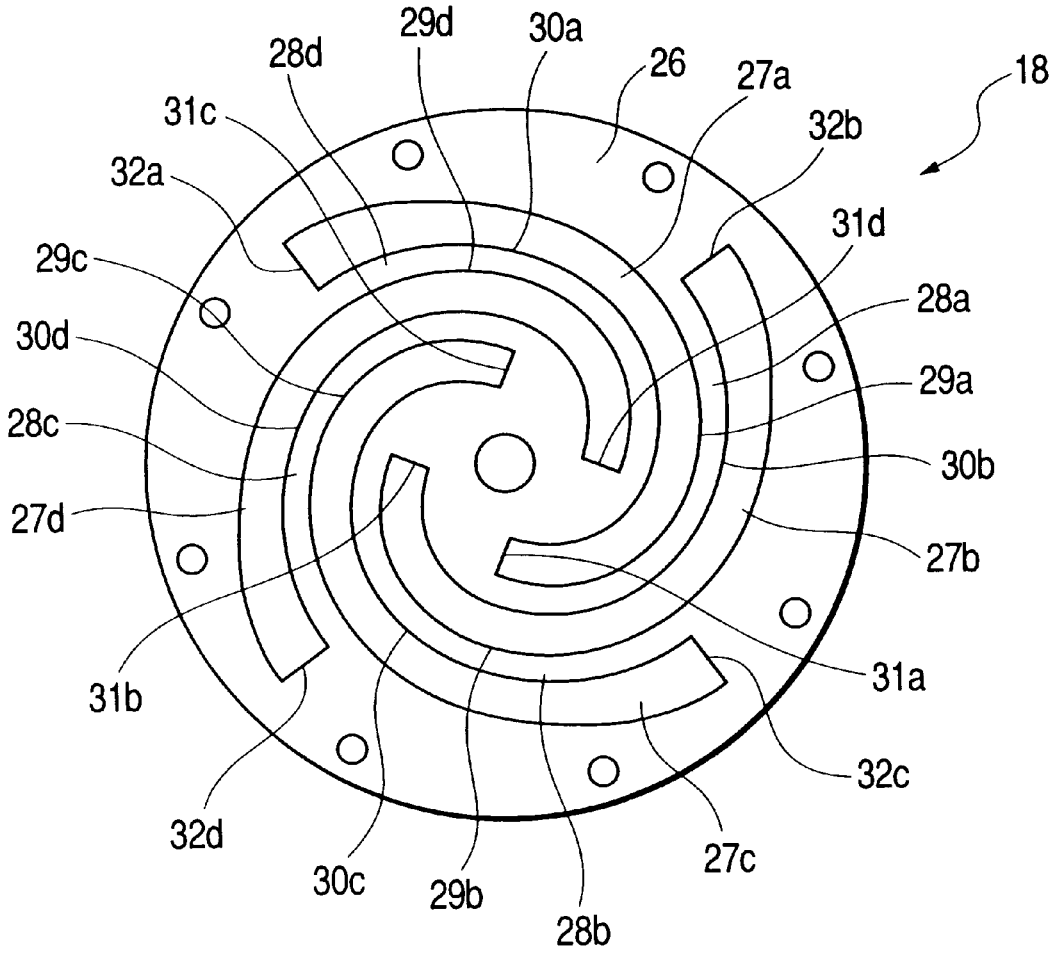
FIG. 4 is a plan view which shows one of discs used in an elastic mechanism according to the second embodiment.

FIG. 4 shows the elastic unit 18 according to the second embodiment of the invention which consists of a plurality of discs 26.

Each of the discs 26, as clearly shown in the drawing, has formed therein the slits 27*a*, 27*b*, 27*c*, and 27*d* which are scrolled to form the curved arms 28*a*, 28*b*, 28*c*, and 28*d*.

The slits 27*a* to 27*d* are defined in width by the inner side edges 29*a*, 29*b*, 29*c*, and 29*d* and the outer side edges 30*a*, 30*b*, 30*c*, and 30*d* of the arms 28*a* to 28*d* and in length by the inner ends 31*a*, 31*b*, 31*c*, and 31*d* and the outer ends 32*a*, 32*b*, 32*c*, and 32*d*, respectively. Inner and outer ends of an individual slit, as for example, the inner and outer ends 31*a* and 32*a* of the slit 27*a* are oriented so as to coincide substantially with portions of normals to a longitudinal center line of the slit 27*a*, respectively. Other arrangements are identical with those of the first embodiment, and explanation thereof in detail will be omitted here.

Figure 5:
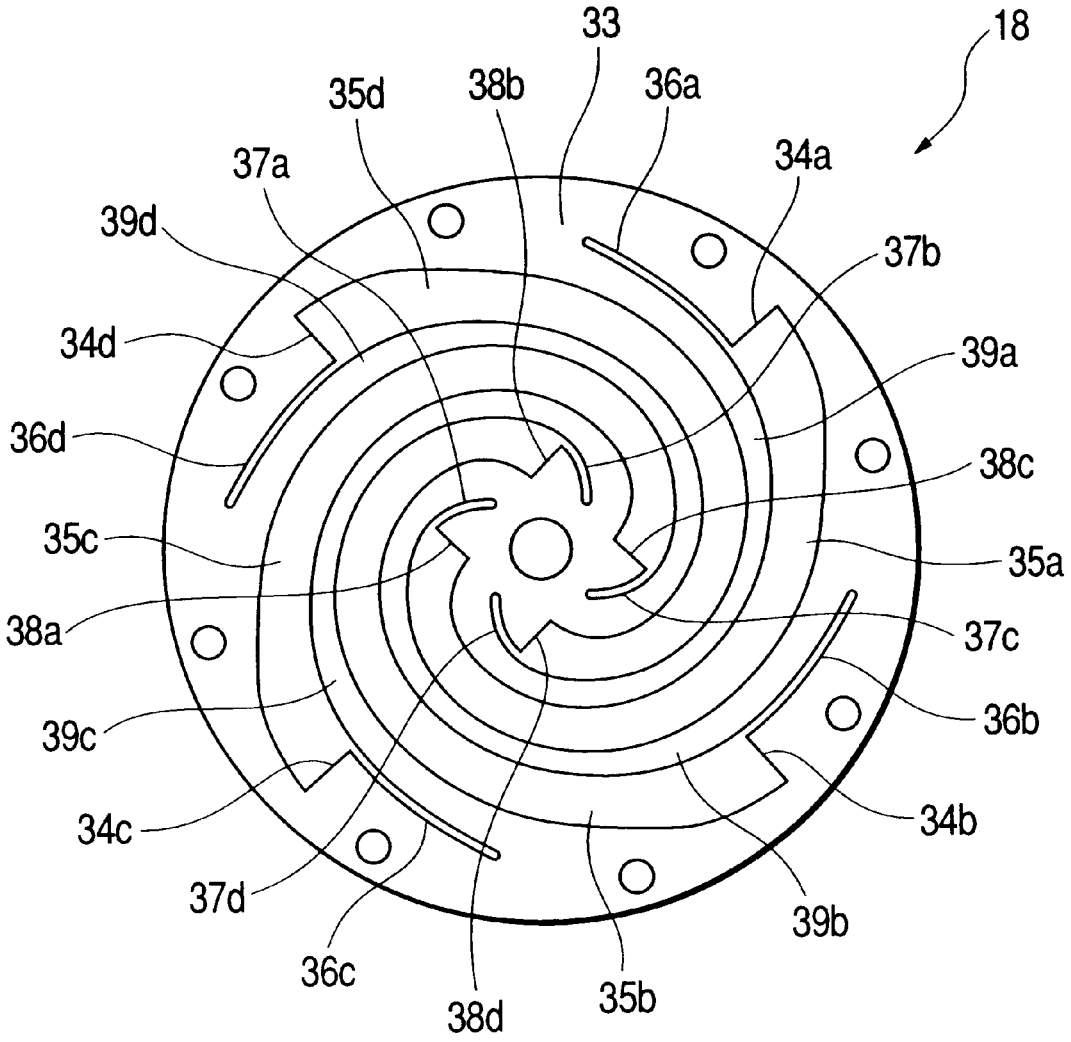
FIG. 5 is a plan view which shows one of discs used in an elastic mechanism according to the third embodiment.

In operation, when the piston 5 reciprocates, it will cause the discs 26 to oscillate in directions perpendicular to the faces of the discs 26. During the oscillation of the discs 26, movement of the arms 28*a* to 28*d* of each of the discs 26 is substantially suppressed by the inner ends 31*a* to 31*d* and the outer ends 32*a* to 32*d* of the slits 27*a* to 27*d* of adjacent one of the discs 26. The inner and outer ends 31*a* to 31*d* and 32*a* to 32*d* of the slits 27*a* to 27*d* are, as described above, oriented so as to coincide with the normals to the longitudinal center lines of the slits 27*a* to 27*d*, respectively, thus causing the stress produced by the oscillation of the arms 28*a* to 28*d* to be distributed uniformly over at least portions of the arms 28*a* to 28*d* held by the inner and outer ends 31*a* to 31*d* and 32*a* to 32*d* of the slits 27*a* to 27*d* of adjacent one of the discs 26. This results in a decrease in maximum stress acting on the ends of each of the arms 28*a* to 28*d* as compared with the first embodiment, thereby increasing the fatigue life of the elastic unit FIG. 5 shows the elastic unit 18 according to the third embodiment of the invention which consists of a plurality of discs 33.

Each of the discs 33, as clearly shown in the drawing, has formed therein the slits 35*a*, 35*b*, 35*c*, and 35*d* which are scrolled to form the curved arms 39*a*, 39*b*, 39*c*, and 39*d*. The slits 35*a* to 35*d* and the arms 39*a* to 39*d* are identical in shape with the slits 27*a* to 27*d* and the arms 28*a* to 28*d* in the second embodiment as shown in FIG. 4.

Each of the discs 33 has also formed therein the outer narrow slits 36*a* to 36*d* and the inner narrow slits 37*a* to 37*d*. The outer narrow slits 36*a* to 36*d* extend outward from the outer ends 34*a* to 34*d* of the slits 35*a* to 35*d* near the middle between adjacent two of the outer ends 34*a* to 34*d* along curved lines extending along inner side edges of the slits 35*a* to 35*d*, respectively. The inner narrow slits 37*a* to 37*d* extend inward from the inner ends 38*a* to 38*d* of the slits 37*a* to 37*d* near the middle between adjacent two of the inner ends 38*a* to 38*d* along curved lines extending along outer side edges of the slits 35*a* to 35*d*, respectively. Other arrangements are identical with those of the second embodiment, and explanation thereof in detail will be omitted here.

The formation of the outer narrow slits 36*a* to 36*a* and the inner narrow slits 37*a* to 37*d* prolongs the effective length of the arms 39*a* to 39*d*, thereby allowing a stroke of the piston 5 to be increased as compared with the second embodiment. Further, during the oscillation of the discs 26, the most of ends of the arms 39*a* to 39*d* of each of the discs 33 near ends of the outer narrow slits 36*a* to 36*b* and the inner narrow slits 37*a* to 37*d* are pressed in the width-wise direction of the arms 39*a* to 39*d* by the outer ends 34*a* to 34*d* and the inner ends 38*a* to 38*d* of adjacent one of the discs 33, respectively, thus causing the stress arising from the oscillation of the arms 39*a* to 39*d* to be distributed uniformly over the ends of the arms 39*a* to 39*d*, which decreases, similar to the second embodiment, the concentration of stress acting on the ends of the arms 39*a* to 39*d*.

Figure 6:
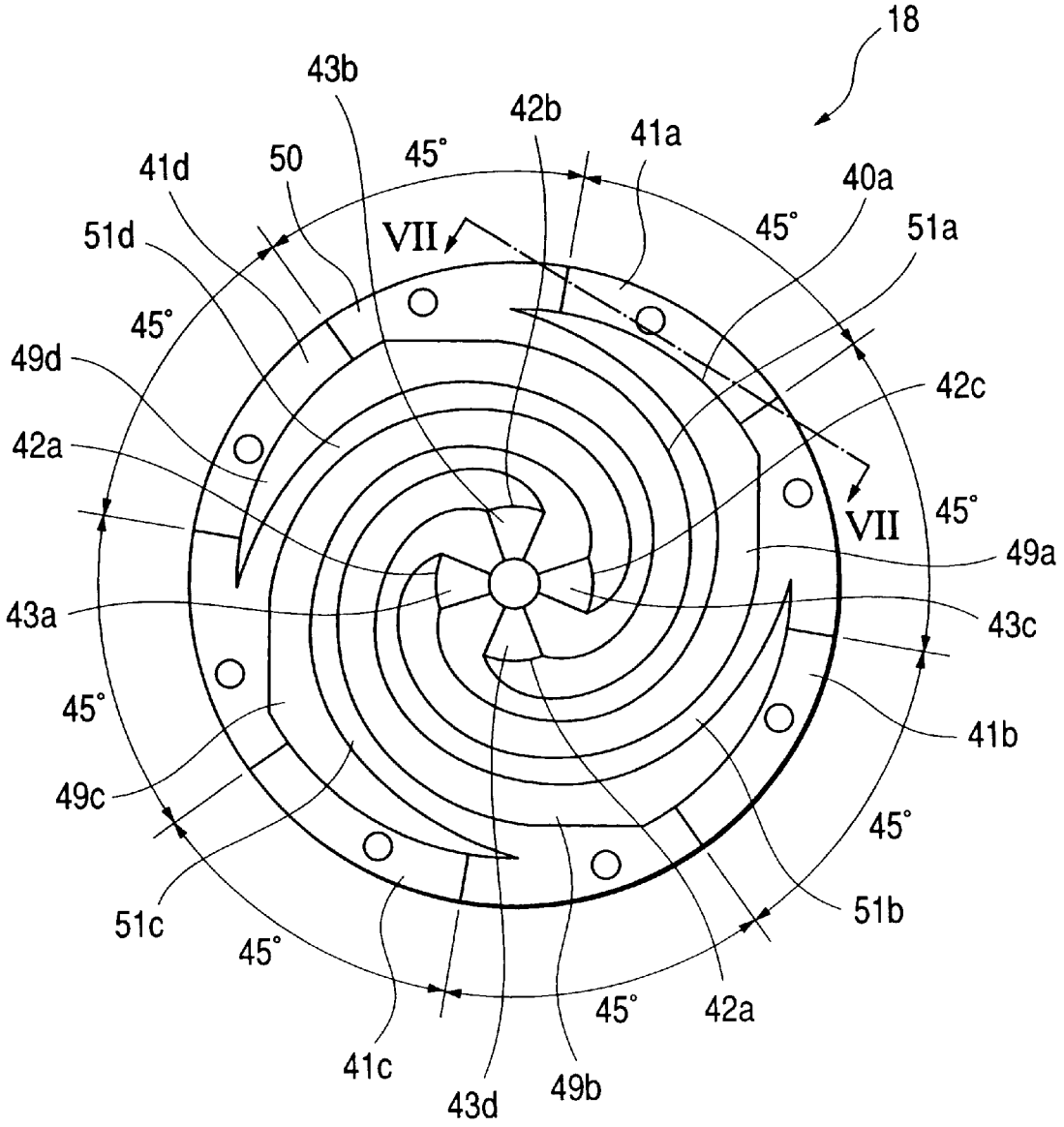
FIG. 6 is a plan view which shows one of discs used in an elastic mechanism according to the fourth embodiment.
Figure 7:
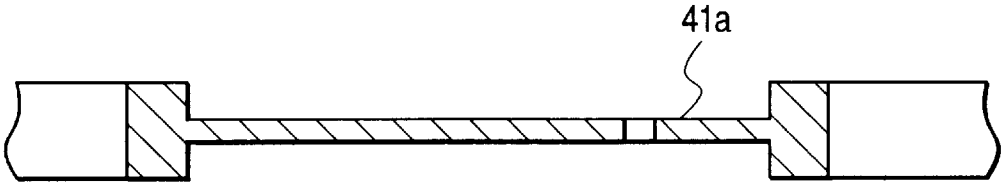
FIG. 7 is a sectional view taken along the line VII—VII in FIG. 6.

FIGS. 6 and 7 show the elastic unit 18 according to the fourth embodiment of the invention which consists of a plurality of discs 50.

Each of the discs 50 has the outer thin-walled portions 41*a*, 41*b*, 41*c*, and 41*d* spaced from each other at regular intervals (i.e., 90° in this embodiment) and the inner thin-walled portions 43*a*, 43*b*, 43*c* and 43*d* spaced from each other at regular intervals (i.e., 90° in this embodiment). Each of the outer thin-walled portions 41*a* to 41*d* is, as clearly shown in FIG. 7, formed by recesses machined in both surfaces of each of the discs 50 outside the outer ends 40*a* to 40*d* of the slits 49*a* to 49*d* over an angular range of 45° (i.e., 360°/(2n)° where n is the number of arms). Similarly, each of the inner thin-walled portions 43*a* to 43*d* is formed by recesses machined in both surfaces of each of the discs 50 inside the inner ends 42*a* to 42*d* of the slits 49*a* to 49*d* over an angular range of 45°.

The discs 50 are, like the above embodiments, shifted in angular position from each other by 45° so that the arms 51*a* to 51*d* of each of the discs 50 may overlap with the slits 49*a* to 49*d* of adjacent one of the discs 50, and peripheral portions between the outer thin-walled portions 41*a* to 41*d* and central portions between the inner thin-walled portions 43*a* to 43*d* of each of the discs 50 may be fitted in the outer thin-walled portions 41*a* to 41*d* and the inner thin-walled portions 43*a* to 43*d* of adjacent one of the discs 50, respectively. This allows the overall thickness of the elastic unit 18 to be decreased below the sum of thickness of the three discs 50 without changing the shape, the thickness, and the spring constant of the arms 51*a* to 51*d*. The formation of the recesses results in a decrease in weight of the elastic unit 18. The resonance frequency of the vibrating compressor may, thus, be increased to enhance the refrigerating capacity thereof.

Each of the outer thin-walled portions 41*a* to 41*d* and the inner thin-walled portions 43*a* to 43*d* may alternatively be formed by machining a single recess in either of the surfaces of each of the discs 50.

Figure 8:
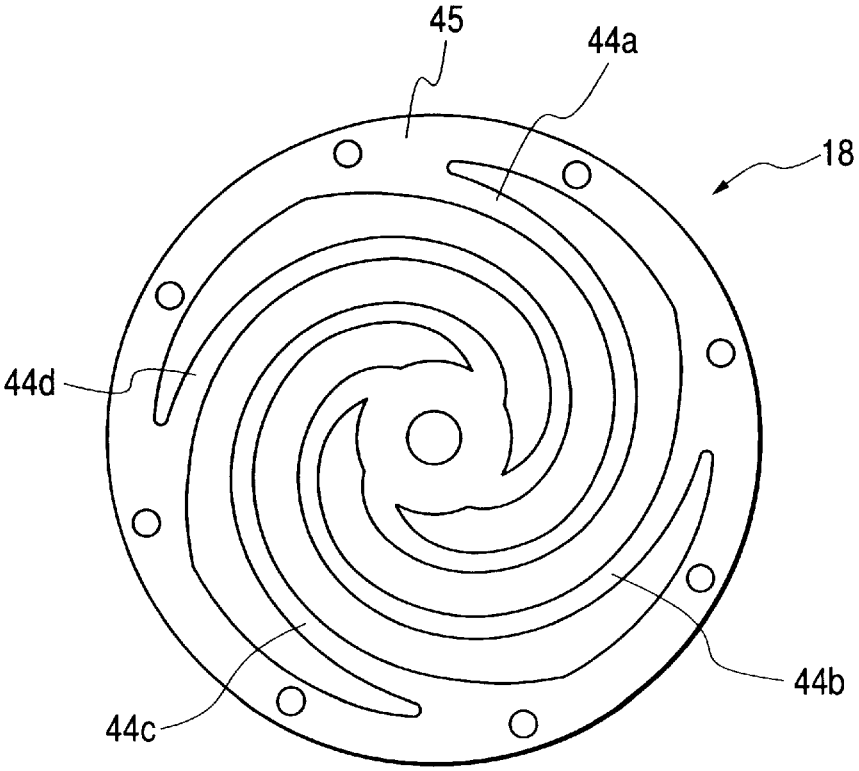
FIG. 8 is a plan view which shows a first disc of an elastic mechanism according to the fifth embodiment.
Figure 9:
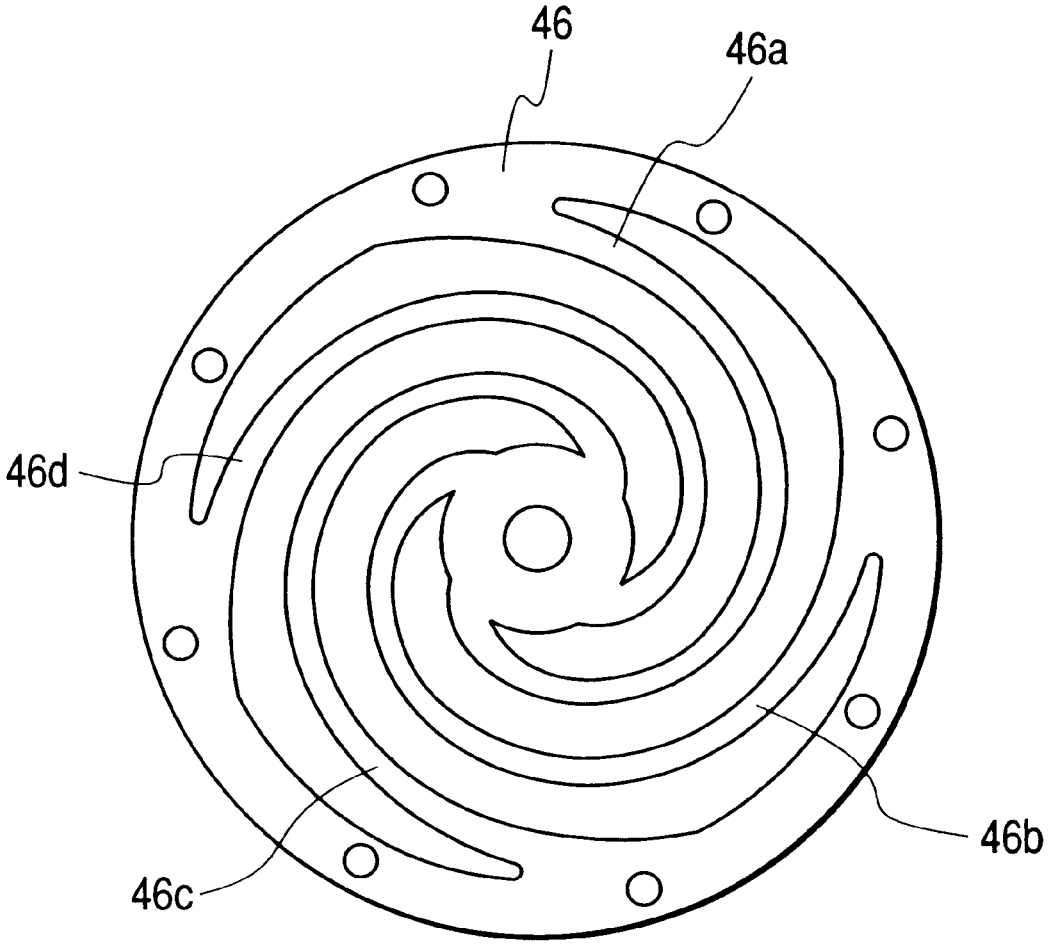
FIG. 9 is a plane view which shows a second disc of an elastic mechanism according to the fifth embodiment.

FIGS. 8 and 9 show the elastic unit 18 according to the fifth embodiment of the invention which consists of a given number of first discs 45 (one is shown in FIG. 8) and a given number of second discs 46 (one is shown in FIG. 9).

Figure 2:
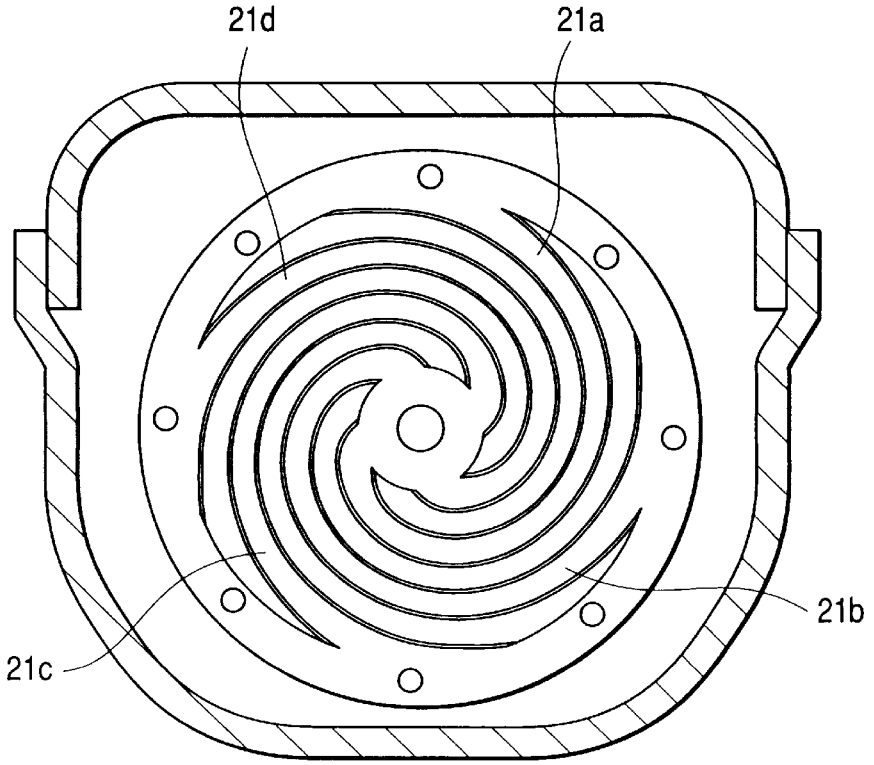
FIG. 2 is a traverse sectional view taken along the line II—II in FIG. 1.
Figure 3:
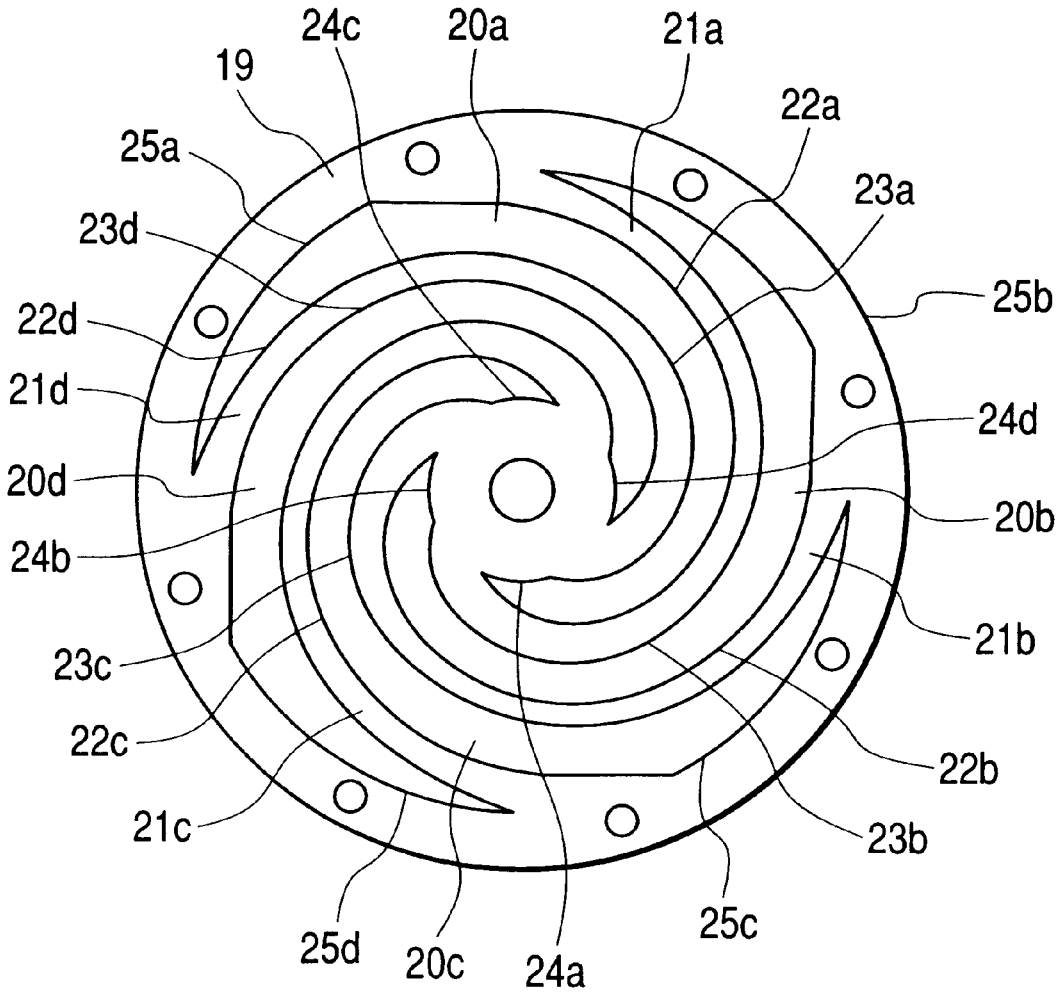
FIG. 3 is a plan view which shows one of discs used in an elastic mechanism used in a vibrating compressor according to the first embodiment.

The first and second discs 45 and 46 are similar in shape of the arms 44*a* to 44*d* and 46*a* to 46*d* to the discs 19 in the first embodiment as shown in FIGS. 2 and 3 except that the arms 44*a* to 44*d* are greater in width than the arms 46*a* to 46*d* so that the spring constant of the arms 44*a* to 44*d* is greater than that of the arms 46*a* to 46*d*. The thickness of the first discs 45 may either be identical with or different from that of the second discs 46.

Therefore, the amount of movement (i.e., the spring constant), weight, and resonance frequency of the elastic unit 18 may be determined by selecting a combination of the first and second discs 45 and 46.

Figure 10:
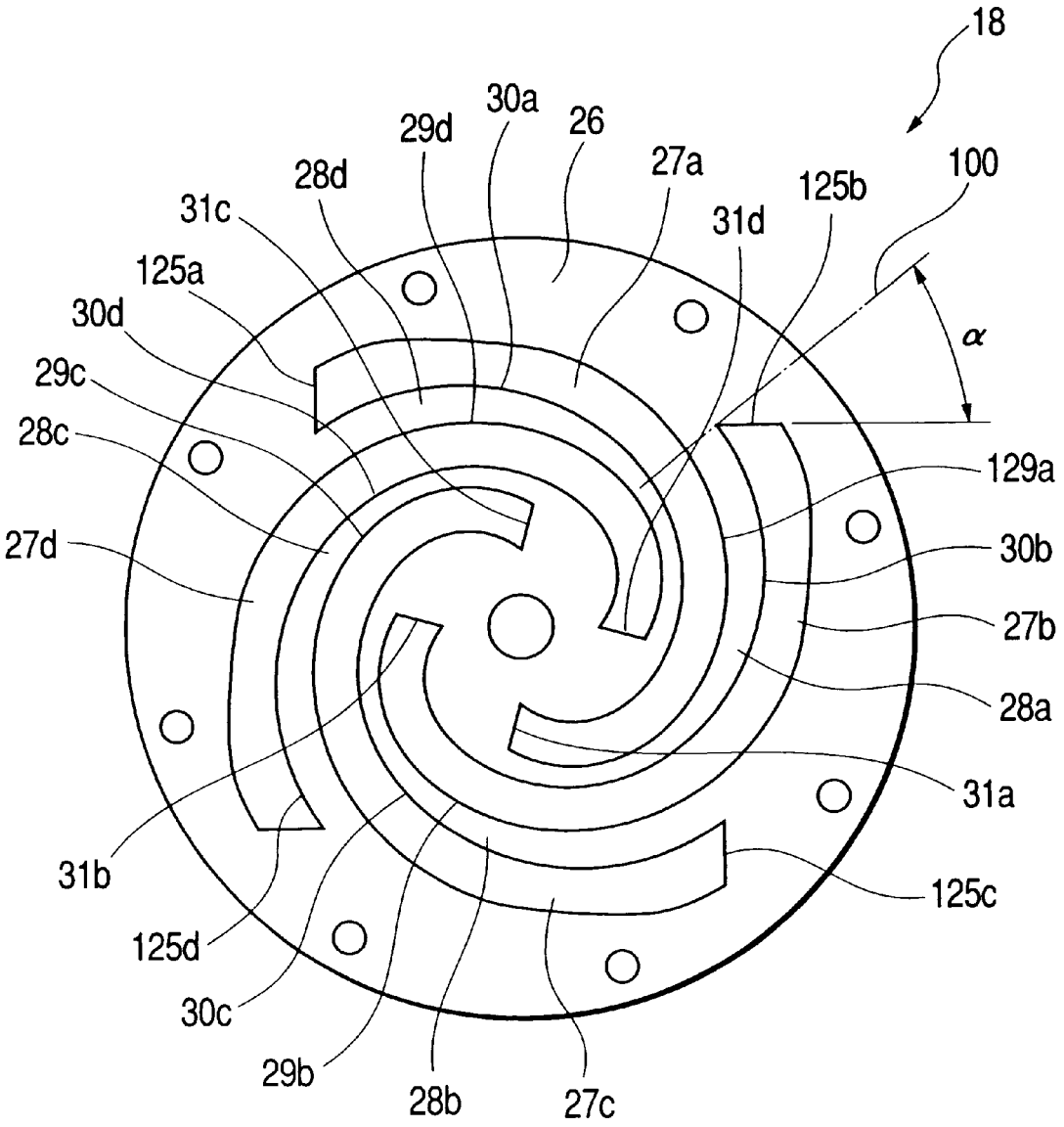
FIG. 10 is a plan view which shows one of discs used in an elastic mechanism according to the sixth embodiment.

FIG. 10 shows the elastic unit 18 according to the sixth embodiment of the invention which is a modification of the second embodiment as shown in FIG. 4. The same reference numbers as employed in FIG. 4 refer to the same parts, and explanation thereof in detail will be omitted here.

The slits 27*a*, 27*b*, 27*c*, and 27*d* formed in each disc 26 have the outer ends 125*a*, 125*b*, 125*c*, and 125*d*, respectively, each of which is oriented outward at an angle of α away from the normal 100 to a longitudinal center line of corresponding one of the slits 27*a* to 27*d* at a point on the outer end of the one of the slits 27*a* to 27*d*.

During oscillation of the discs 26 arising from the reciprocating motion of the piston 5, outer portions of the arms 28*a* to 28*d* near the peripheral portion 18*b* of each of the discs 26 undergo a greater torsion than that acting on inner portions of the arms 28*a* to 28*d*, so that a greater stress concentrates on portions of the arms 28*a* to 28*d* of each of the discs 26 suppressed in motion by the outer ends 125*a* to 125*d* of the slits 27*a* to 27*d* of adjacent one of the discs 26. The distribution of the stress in the width-wise direction of the arms 28*a* to 28*d* depends upon the orientation of the outer ends 125*a* to 125*d* of the slits 27*a* to 27*d*. Specifically, a maximum level of the stress depends upon the orientation of the outer ends 125*a* to 125*d* of the slits 27*a* to 27*d*. It is found experimentally that the stress acting on the outer portions of the arms 28*a* to 28*d* becomes smaller than an allowable level when the orientation of the outer ends 125*a* to 125*d* of the slits 27*a* to 27*d*, that is, the angle a is within a range of $-10° \leqq \alpha \leqq 60°$, preferably, within a range of $10° \leqq \alpha \leqq 500°$.

Figure 11:
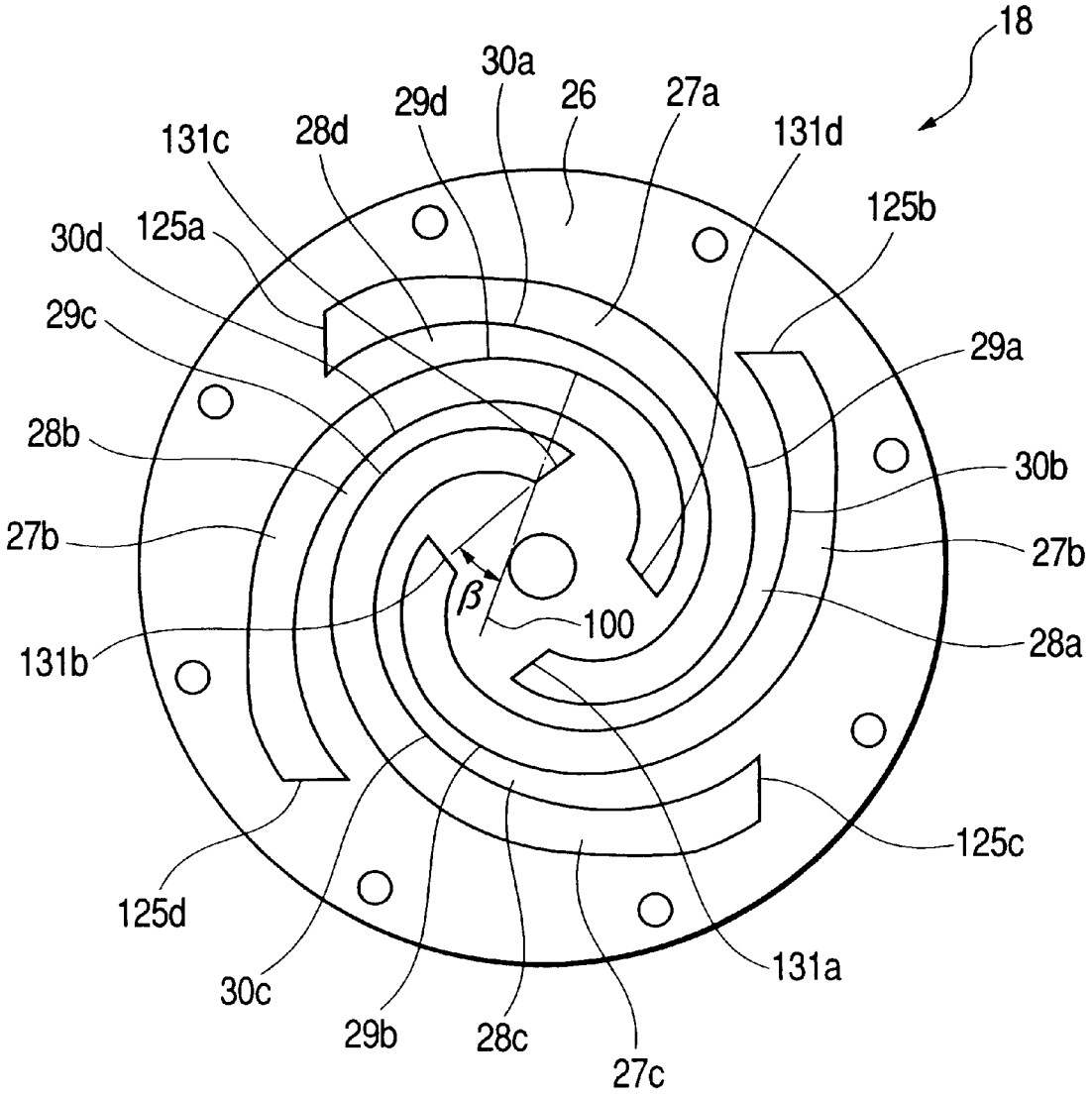
FIG. 11 is a plan view which shows one of discs used in an elastic mechanism according to the seventh embodiment.

FIG. 11 shows the elastic unit 18 according to the seventh embodiment of the invention which is a modification of the sixth embodiment as shown in FIG. 10. The same reference numbers as employed in FIG. 10 refer to the same parts, and explanation thereof in detail will be omitted here.

The slits 27*a*, 27*b*, 27*c*, and 27*d* formed in each disc 26 have the inner ends 131*a*, 131*b*, 131*c*, and 131*d*, respectively, each of which is oriented inward at an angle of β away from the normal 100 to the longitudinal center line of corresponding one of the slits 27*a* to 27*d* at a point on the inner end of the one of the slits 27*a* to 27*d*.

During oscillation of the discs 26 arising from the reciprocating motion of the piston 5, inner portions of the arms 28*a* to 28*d* near the central portion 18*a* of each of the discs 26 undergo a certain degree of torsion although it is, as described above, smaller than that acting on the outer portions of the arms 28*a* to 28*d*, so that the stress concentrates on portions of the arms 28*a* to 28*d* of each of the discs 26 suppressed in motion by the inner ends 131*a* to 131*d* of the slits 27*a* to 27*d* of adjacent one of the discs 26. The distribution of the stress in the width-wise direction of the arms 28*a* to 28*d* depends upon the orientation of the inner ends 131*a* to 131*d* of the slits 27*a* to 27*d*. Specifically, a maximum level of the stress depends upon the orientation of the inner ends 131*a* to 131*d* of the slits 27*a* to 27*d*. It is found experimentally that the stress acting on the inner portions of the arms 28*a* to 28*d* becomes smaller than an allowable level when the orientation of the inner ends 131*a* to 131*d* of the slits 27*a* to 27*d*, that is, the angle β is within a range of $-30° \leqq \alpha \leqq 30°$.

Figure 12:
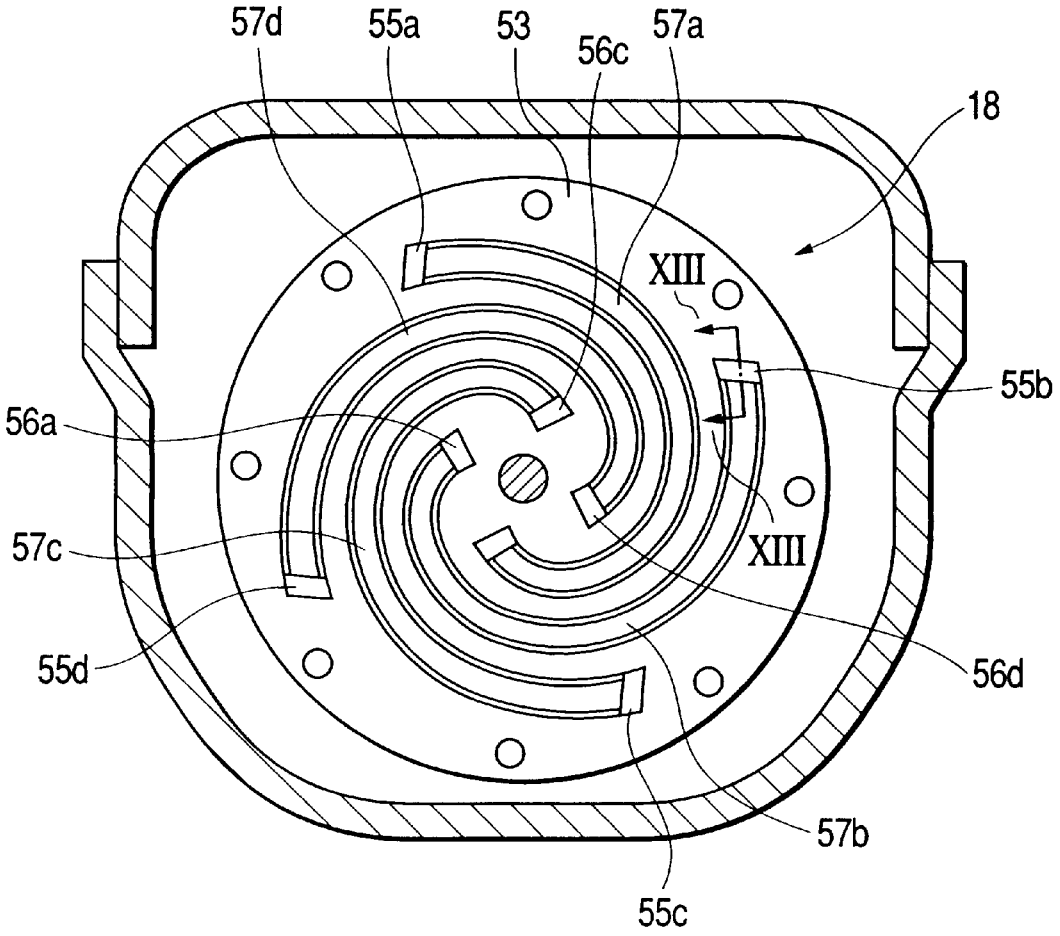
FIG. 12 is a traverse sectional view which shows a vibrating compressor having an elastic mechanism according to the eighth embodiment.
Figure 13:
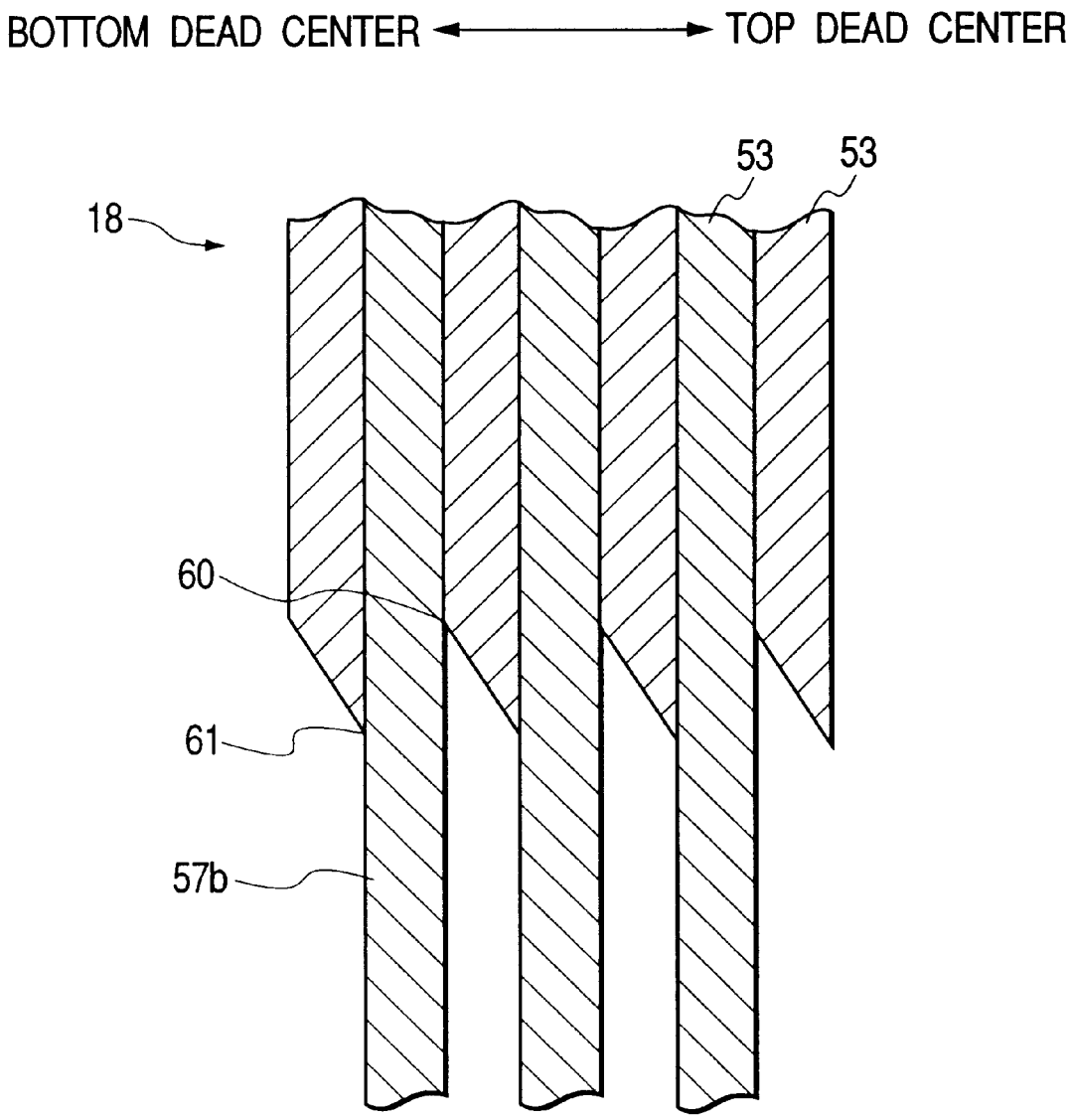
FIG. 13 is a sectional view taken along the line XIII—XIII in FIG. 12.

FIGS. 12 and 13 show the elastic unit 18 according to the eighth embodiment of the invention which is different from the seventh embodiment, as shown in FIG. 12, only in shape of outer and inner ends 55*a* to 55*d* and 56*a* to 56*d* of slits formed in each disc 53. FIG. 12 illustrates the slits of the outermost one of the discs 53 coincide with the arms 57*a* to 57*d* of adjacent one of the discs 53. FIG. 13 is a cross sectional view taken along the line XIII—XIII in FIG. 12 which illustrates the seven discs 53 are laid to overlap each other.

Each of the outer ends 55*a* to 55*d* of the slits is, as clearly shown in FIG. 13, has a tapered surface facing the bottom dead center of the piston 5 (i.e., in a direction opposite the head of the piston 5). Similarly, each of the inner ends 56*a* to 56*d* of the slits has a tapered surfaces facing the bottom dead center of the piston 5. Therefore, during the intake stroke of the piston 5 to the bottom head center, the arms 57*a* to 57*b* of each of the discs 53 other than one closest to the top dead center are suppressed in motion by acute-angled edges 61 of the outer and inner ends 55*a* to 55*d* and 56*a* to 56*d* of the slits of adjacent one of the discs 53. During the compression stroke of the piston 5 to the top dead center, the arms 57*a* to 57*b* of each of the discs 53 other than one closest to the bottom dead center are suppressed in motion by obtuse-angled edges 60 of the outer and inner ends 55*a* to 55*d* and 56*a* to 56*d* of the slits of adjacent one of the discs 53. Specifically, the effective length of the arms 57*a* to 57*b* on the compression stroke becomes greater than that on the intake stroke, so that the spring constant of the arms 57*a* to 57*b* on the compression stroke becomes smaller than that on the intake stroke.

Accordingly, when the refrigerating capacity of a refrigerator is lowered by elevating the pressure in a back pressure chamber to shift the center of amplitude of the piston 5 toward the top dead center, the average spring constant of the arms 57*a* to 57*b* during one stroke and the resonance frequency become small, thus resulting in an increase in variable amount of the refrigerating capacity above a value that is estimated based on a change in amplitude of the piston 5. The refrigerating efficiency of the refrigerator under control of the refrigerating capacity is, thus, improved. This allows the back pressure when the refrigerator is operating at a minimum refrigerating capacity to be lowered to reduce the leakage of refrigerant from the back pressure chamber to the compression chamber 16.

Instead of formation of the tapered surfaces on the outer and inner ends 55*a* to 55*d* and 56*a* to 56*d* of the slits, spacers having tapered ends may be interposed between adjacent two of the discs 53 to suppress the inner and outer ends of the arms 57*a* to 57*b* in motion during oscillation of the discs 56.

This embodiment may be used with any one of the above first to seventh embodiments.

While the present invention has been disclosed in terms of the preferred embodiment in order to facilitate a better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims. For example, each discs of the elastic unit 18 may have formed therein a single slit extending in a scroll fashion to form a single arm. Further, the curvature and length of the arms may be different from each other as long as the arms of each disc are formed so as to overlap the slits of adjacent one.

What is claimed is:

1. A vibrating compressor comprising:

an enclosed casing;

a block having formed therein a cylinder within which a piston reciprocates to change a volume of a compression chamber;

a moving mechanism moving the piston within the cylinder in a first direction; and an elastic unit including a plurality of plates each of which is connected at a first portion to said block and at a second portion to the piston and each of which has formed therein at least one slit curved to define an arm which is elastically flexed to urge the piston in a second direction opposite the first direction in response to the movement of the piston through said moving mechanism, the slit of each of the plates being greater in width than the arm, the plates being disposed adjacent to each other so that the arm of each of the plates overlaps with the slit of adjacent one of the plates.

2. A vibrating compressor as set forth in claim 1, wherein the slit of each of the plates has an end oriented geometrically so as to coincide with a portion of a normal to a longitudinal center line of the slit.

3. A vibrating compressor as set forth in claim 1, further comprising a second curved slit extending from an end of the slit, having a width smaller than that of the slit.

4. A vibrating compressor as set forth in claim 1, wherein each of the plates has formed therein recesses adjacent ends of the slit and wherein the plates coincide in center with each other and are shifted in angular position from each other so that portions of each of the plates neighboring the recesses thereof engage the recesses of adjacent one of the plates.

5. A vibrating compressor as set forth in claim 1, wherein the arm of one of the plates is different in dimension from that of another of the plates.

6. A vibrating compressor as set forth in claim 1, wherein the slit of each of the plates has an outer end which is oriented outward at a given angle away from a normal to a longitudinal center line of the slit, the given angle ranging from −10° to 60°.

7. A vibrating compressor as set forth in claim 6, wherein the given angle ranges from 10° to 50°.

8. A vibrating compressor as set forth in claim 1, wherein the slit of each of the plates has an inner end which is oriented inward at a given angle away from a normal to a longitudinal center line of the slit, the given angle ranging from −30° to 30°.

9. A vibrating compressor as set forth in claim 1, wherein ends of the slit of each of the plates engage and hold outer and inner end portions of the arm of adjacent one of the plates during flexing of the arms accompanied by movement of the piston, and wherein the ends of the slit of each of the plates have tapered surfaces facing a bottom dead center of the piston.

* * * * *